US005440838A

United States Patent [19]

Lesser

[11] Patent Number: 5,440,838

[45] Date of Patent: Aug. 15, 1995

[54] MOTORIZED VERTICAL LIFT GATE

[76] Inventor: Christopher M. Lesser, 3036 S. Wolff St., Denver, Colo. 80236

[21] Appl. No.: 248,437

[22] Filed: May 24, 1994

[51] Int. Cl.[6] ..... E05F 11/24

[52] U.S. Cl. ..... 49/340; 49/385

[58] Field of Search ..... 49/25, 49, 340, 357, 49/327, 328, 329, 324, 385

[56] References Cited

U.S. PATENT DOCUMENTS

| | | | |
|---|---|---|---|
| 1,672,723 | 6/1928 | McClary | 49/385 X |
| 2,826,840 | 3/1958 | Cooper et al. | 49/385 X |
| 3,823,510 | 7/1974 | Panaccione | 49/247 |
| 3,839,826 | 10/1974 | Ries | 49/385 X |
| 4,519,164 | 5/1985 | Porter | 49/340 X |
| 4,658,543 | 4/1987 | Carr | 49/340 X |
| 5,136,810 | 8/1992 | DeWitt, III | 49/49 |
| 5,299,386 | 4/1994 | Naegelli et al. | 49/340 |

*Primary Examiner*—Jerry Redman

[57] ABSTRACT

A motorized vertical lift gate whose operating mechanism is very compact, simple, and concealed inside a hollow gate post. Said gate comprises a plurality of horizontal rails arranged in a parallel fashion connected by vertical members and pivotally mounted at one end of the upper most rail to a gate post about which the gate pivots open to a true vertical position. The operating mechanism is activated by various ways, including remote control, vehicle detection, keyless entry, and manual switches.

3 Claims, 6 Drawing Sheets

MOTORIZED VERTICAL LIFT GATE

BACKGROUND OF THE INVENTION

1. Field of the Invention

This invention relates to vertical lift gates used to control the access of a pathway. More specifically, this invention relates to electrically powered vertical lift gates which are activated manually or through the use of remote controls and sensors.

2. Prior Art

Vertical lift gates have been in use more than a century, as evidenced in U.S. Pat. Nos. 391,734 to A. H. Broad and 606,250 to S. Stout. Obstructions on either side of the gate, such as livestock, vehicles, or snow, do not affect the operation of vertical lift gates. This allows vertical lift gates to be used in areas where conventional swing gates are not practical. Many variations of the same basic vertical lift gate design have been patented through out the years.

U.S. Pat. Nos. 391,734 to Broad; 798,846 to Van Pelt; 1,672,723 to McClary; 2,083,855 to McReynolds; 2,563,894 to White; 2,807,107 to Goulet; 3,823,510 to Panaccione; 4,519,164 to Porter; and 4,658,543 to Carr all teach gates that expand as they are lowered and collapse together as they are raised. Most of the early designs require many moving parts, including large counterbalance weights, overhead mechanisms, ropes, pulleys, large gears, and vehicle ramps. These early designs are large in size and their many moving parts require regular maintenance for proper operation. In contrast, modern designs eliminate overhead mechanisms, counterbalance weights, and vehicle ramps.

All of the prior designs partially obstruct the pathway when in an open position, with the exception of U.S. Pat. Nos. 3,823,510 to Panaccione and 4,519,164 to Porter. U.S. Pat. Nos. 391,734 to Broad; 798,846 to Van Pelt; 1,672,723 to McClary; 2,083,855 to McReynolds; 2,563,894 to White; 2,807,107 to Goulet; 4,658,543 to Carr are all incapable of opening to a true vertical position due to the mechanics incorporated into the various collapsing gate designs. These gates comprise two categories:

- Gates with two or more horizontal rails that are all pivotally mounted at one end to a gate post and are also connected by vertical members.
- Gates with a single horizontal support rail pivotally mounted at one end to a gate post and to which lower horizontal rails are attached and hang freely from vertical members.

The gates of the first category are prevented from opening to a true vertical position when a lower rail contacts the pivot point of an upper rail, the vertical members prevent the horizontal rails from coming together, or the counterbalance weight contacts the gate post. This is shown in U.S. Pat. No. 4,658,543 to Carr, where the vertical members 19 prevent the horizontal spars 17 & 18, as viewed in FIGS. 1 & 2, from coming together and achieving a true vertical position.

The gates of the second category are prevented from opening to a true vertical position due to the counterbalance weights contacting the gate posts or in the case of U.S. Pat. No. 1,672,723 to McClary, the left most vertical bar 17, as viewed in FIG. 4, contacting the post 10, prevents the gate from achieving a true vertical position.

All of these gates, when open, partially obstruct the pathway and this forces the use of a wider than normal gate. More specifically, if a minimum of 10 feet is required for passage, then the actual width of the gate must be greater than 10 feet, as either the lower rail or the raised end of the gate protrudes into the pathway. These prior designs are unsuitable for replacements to conventional swinging gates when space is limited and the current width of the pathway must be maintained.

U.S. Pat. Nos. 3,823,510 to Panaccione and 4,519,164 to Porter, teach gates which open to a true vertical position. However, the Panaccione gate operating mechanism is very complex and uses several motors which increases the need for maintenance. The rails of the Porter gate are offset and do not "hang" directly below one another. This creates a stair step effect when the gate is in a closed position and requires more space as compared to other designs. This design also requires the enclosure containing the gate operating mechanism to be open on at least one side. This design is unsuitable in climates where weather is severe and snow or rain may be blown into the enclosure, interfering with normal operation. In addition the Porter gate has many moving parts, including chain drives, rigid links, cams, pulleys and cables.

Another problem with the prior designs is the enclosures containing the gate operating mechanisms. The older designs did not enclose the gate operating mechanisms because they were too large and it would have been impractical. However, the modern designs do enclose the gate operating mechanisms, but these enclosures are large. This compounds the problem of using these gates as replacements for conventional swing gates, where space is limited. U.S. Pat. No. 4,658,543 to Cart, shows a large enclosure attached to a support post containing the gate operating mechanism. This requires much more space than a conventional gate post and makes this design especially unsuitable for use as a replacement gate.

Whatever the merits, features, and advantages of the above cited references, none of them achieves or fulfills the purposes and objectives of the current vertical lift gate of the present invention.

SUMMARY OF THE INVENTION

The vertical lift gate of this invention is made up of a gate mounted to a hollow gate post which encloses and protects a compact operating system from the weather. The gate consists of mutiple horizontal rails attached by vertical members, all of which fold tight together end allow the gate to open to a true vertical position. The compact design of the operating mechanism and the true vertical open position of this gate make it an ideal replacement for conventional swing gates where space is limited.

DETAILED DESCRIPTION OF THE INVENTION

Figure 1:
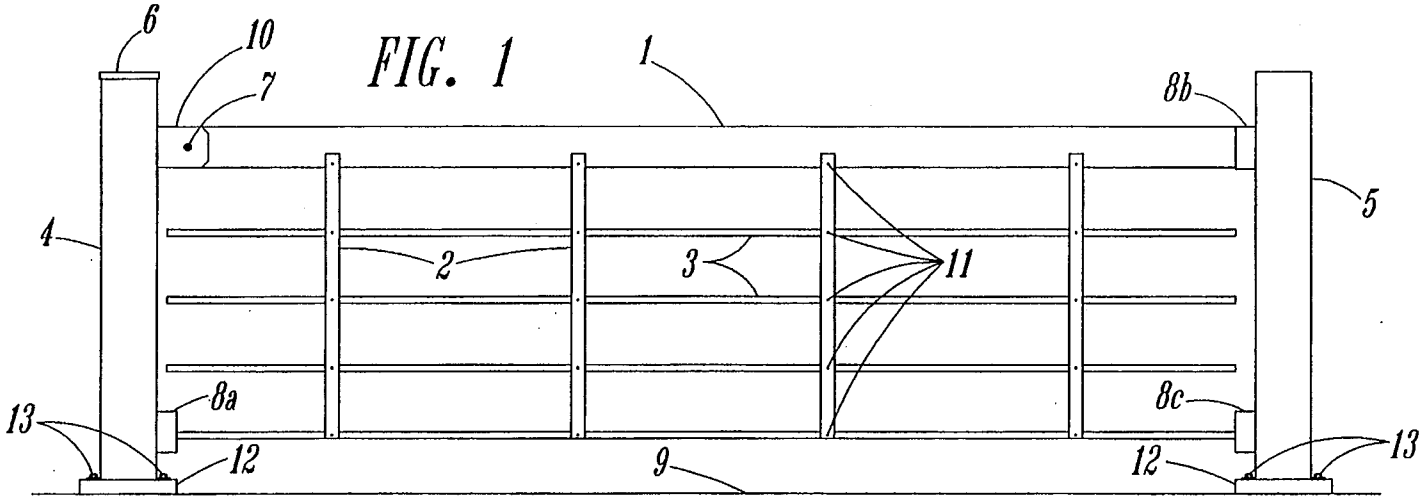
FIG. 1 is a view of the gate in the closed position.

Referring to FIG. 1 a preferred embodiment of the present invention is shown as viewed from the front of the gate. There are two concrete caissons 12 set into the ground on either side of a pathway 9. A pathway is defined as a walkway, roadway, driveway, or any space used for passage from one place to another. Attached to the caissons 12 by anchor bolts 13 or other suitable fasteners are gate posts 4 and 5. Gate post 4 is hollow and comprises a V-shaped flange 8*a*, a pivot support arm 10, and a lid 6 that may be removed to access the inside of the post. Attached to the pivot support arm 10 by a pivot bolt 7 is a gate comprising a large horizontal rail 1, below which is disposed a plurality of smaller horizontal rails 3 in a parallel fashion, all of said rails being connected by free hanging vertical members 2 at bolted connections 11. All bolted connections 11 are pivotal and the entire gate is constructed so as the horizontal rails will collapse together when the gate is raised about the pivot bolt 7. The second gate post 5 comprises two V-shaped flanges 8*b* and 8*c*. When the gate is closed, the free end of the large horizontal rail 1 is supported by flange 8*b*. As is readily apparent from FIG. 1, the gate appears to be of conventional construction and operation when in the closed position.

Figures 2, 8:
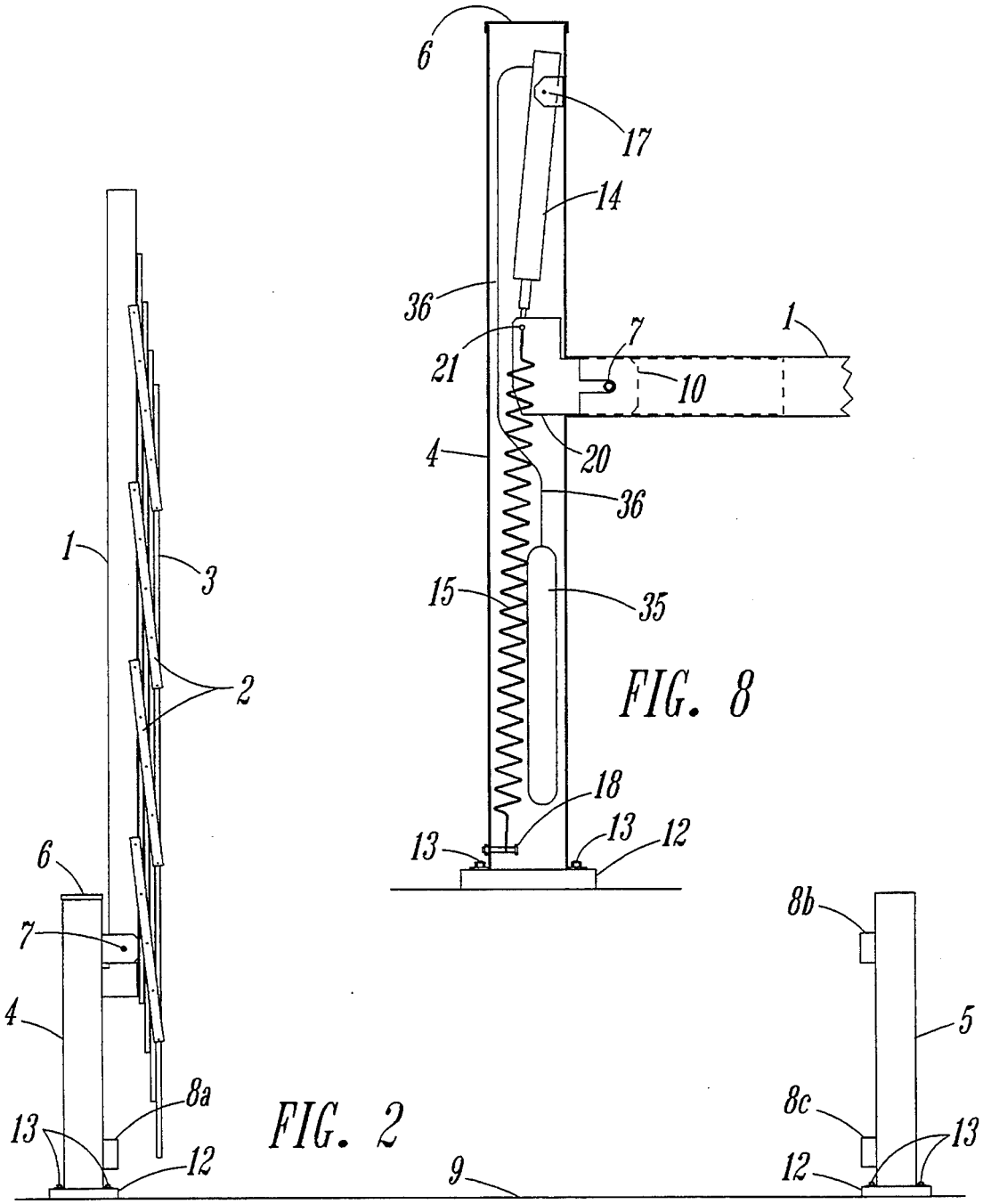
FIG. 2 is a view of the gate in the fully open position.
FIG. 8 is a view of the gate operating system with the linear actuator positioned above the gate.

Referring to FIG. 2, the gate is open with the large rail 1 and the smaller rails 3 in a true vertical position and folded tightly together.

Figure 3:
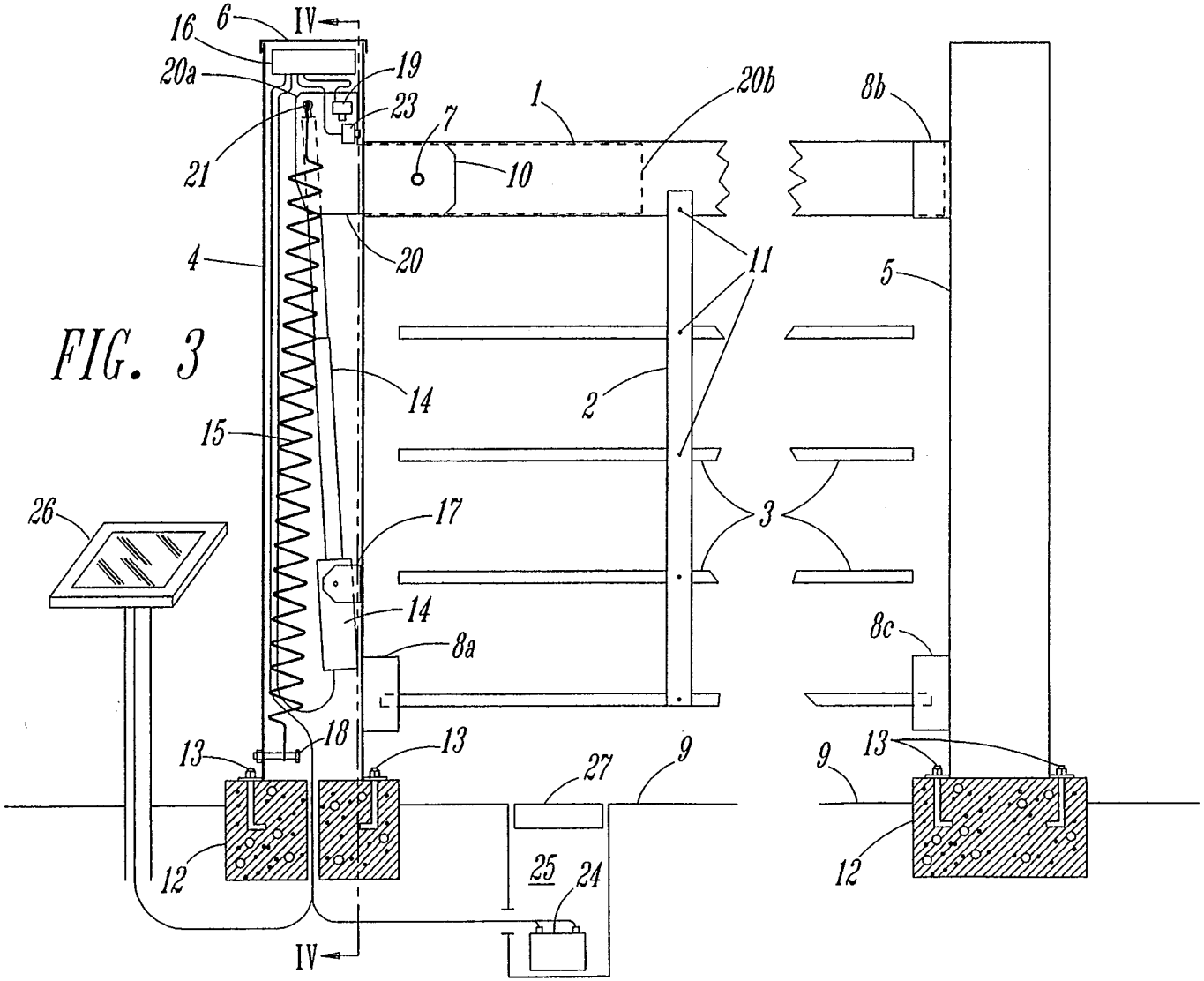
FIG. 3 is a detailed view of the gate posts and gate in the closed position with the center section of the gate removed to enlarge the figure for better detail. The front side of the gate post is cut away to expose the operating system that lifts the gate.

FIG. 3 is an overall view of the gate showing gate post 4 with one side cut away exposing the interior containing the gate operating system and controls. Also shown is the presently preferred power source for the gate. The offset pivot arm 20 passes through a small opening in the upper end of gate post 4 and is connected to the pivot support arm 10 by the pivot bolt 7. Attached to the exterior end 20*b* of the offset pivot arm 20 is the large rail 1. To the interior end 20*a* of the offset pivot arm 20 at point 21 are connected two counterbalance springs 15 of which only the front spring is visible from this view. The other ends of the counterbalance springs 15 are fastened at position 18 at the opposite end of the gate post 4. Attached between the two counterbalance springs 15 to the offset pivot arm 20 at point 21 is the screw type linear actuator 14. The opposite end of the linear actuator 14 is connected to the gate post 4 by bracket 17 and electrically connected to the gate controller 16 which is disposed in the upper end of gate post 4 just inside the lid 6. Also connected electrically to the gate controller 16 are the open limit switch 19 and the close limit switch 23 mounted to the offset pivot arm 20.

Power is supplied to the gate controller 16 from the battery 24 located inside the below ground vault 25 which is covered by the vault lid 27. The battery charge is maintained by the photo voltaic solar panel 26. The gate is activated when the gate controller 16 receives a signal from a remote transmitter, keyless entry system, vehicle detection system, manual switch, or any other activation device used to operate the gate. The gate controller 16 supplies power to the linear actuator 14 which pulls down on the offset pivot arm 20 at connection 21. This causes the large rail 1 along with the vertical members 2 and smaller rails 3 to pivot up vertically about the pivot bolt 7 until the open limit switch 19 contacts the inside of gate post 4. The gate controller 16 shuts off the power to the linear actuator 14 stopping the gate in an open position with the smaller rails 3 folded tightly against the large rail 1 as viewed in FIG. 2. Upon receiving a signal to close, the gate controller 16 supplies power of reversed polarity to the linear actuator 14 which pushes up on the offset pivot arm 20 at point 21 causing the large rail 1 along with the vertical members 2 and smaller rails 3 to pivot down vertically about the pivot bolt 7 until the close limit switch 23 contacts the inside of gate post 4 stopping the gate.

Figure 4:
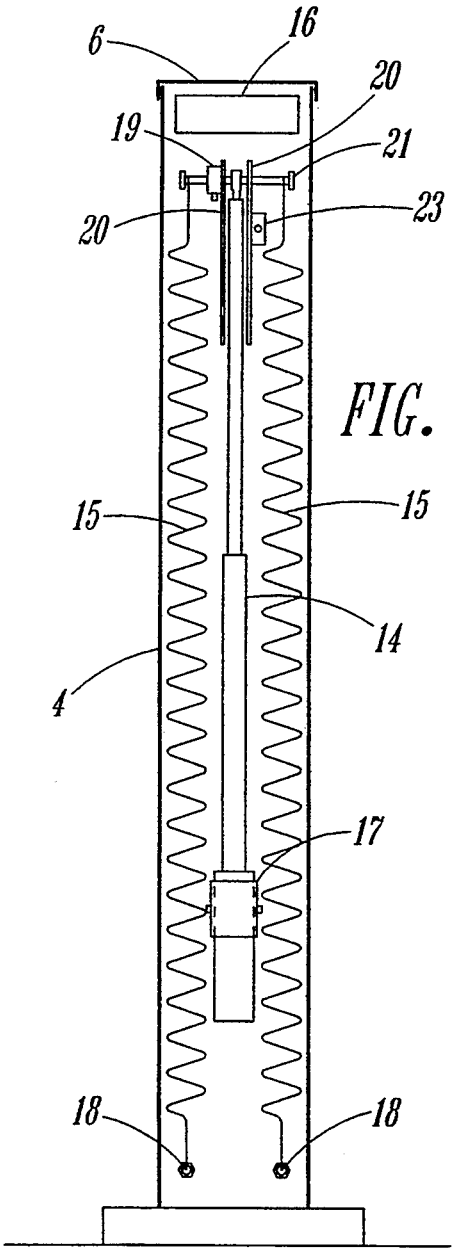
FIG. 4 is a sectional view along the plane IV—IV in FIG. 3 and shows the positions of the counterbalance springs, the linear actuator, and the open and close limit switches.

A detailed view of the gate operating system is shown in FIG. 4 as viewed along the section line IV—IV of FIG. 3. The counterbalance springs 15 are located on either side of the offset pivot arm 20 and the linear actuator 14 is located between the counterbalance springs. The open limit switch 19 and close limit switch 23 are located on either side of the offset pivot arm 20.

Figure 5:
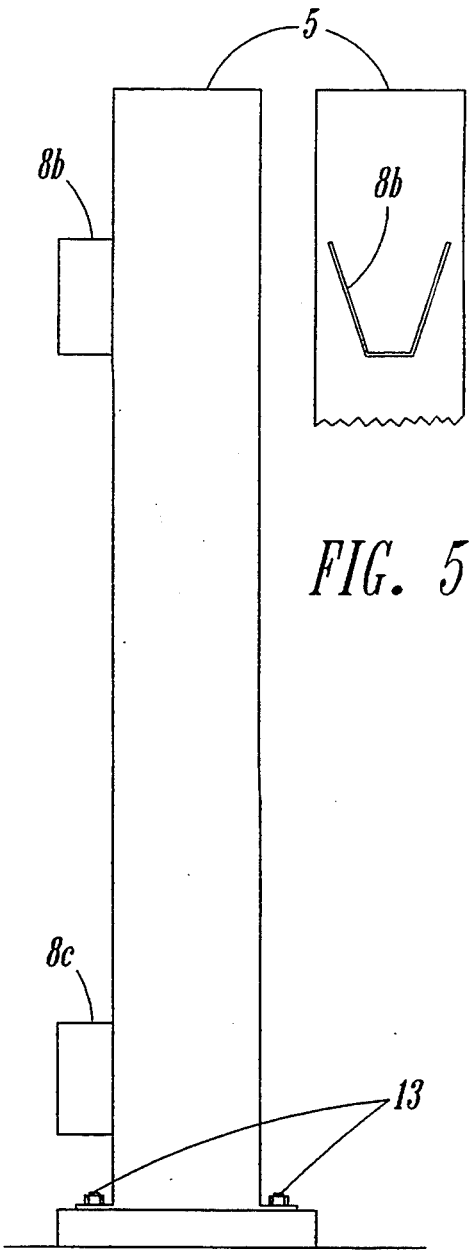
FIG. 5 is a view of the second gate post on which the free end of the gate is supported.

FIG. 5 is a view of the second gate post 5 with the top section of the gate post rotated 90 degrees toward the viewer. In the closed position the free end of the gate is supported by the V-shaped flanges 8*b* and 8*c*.

Figure 6:
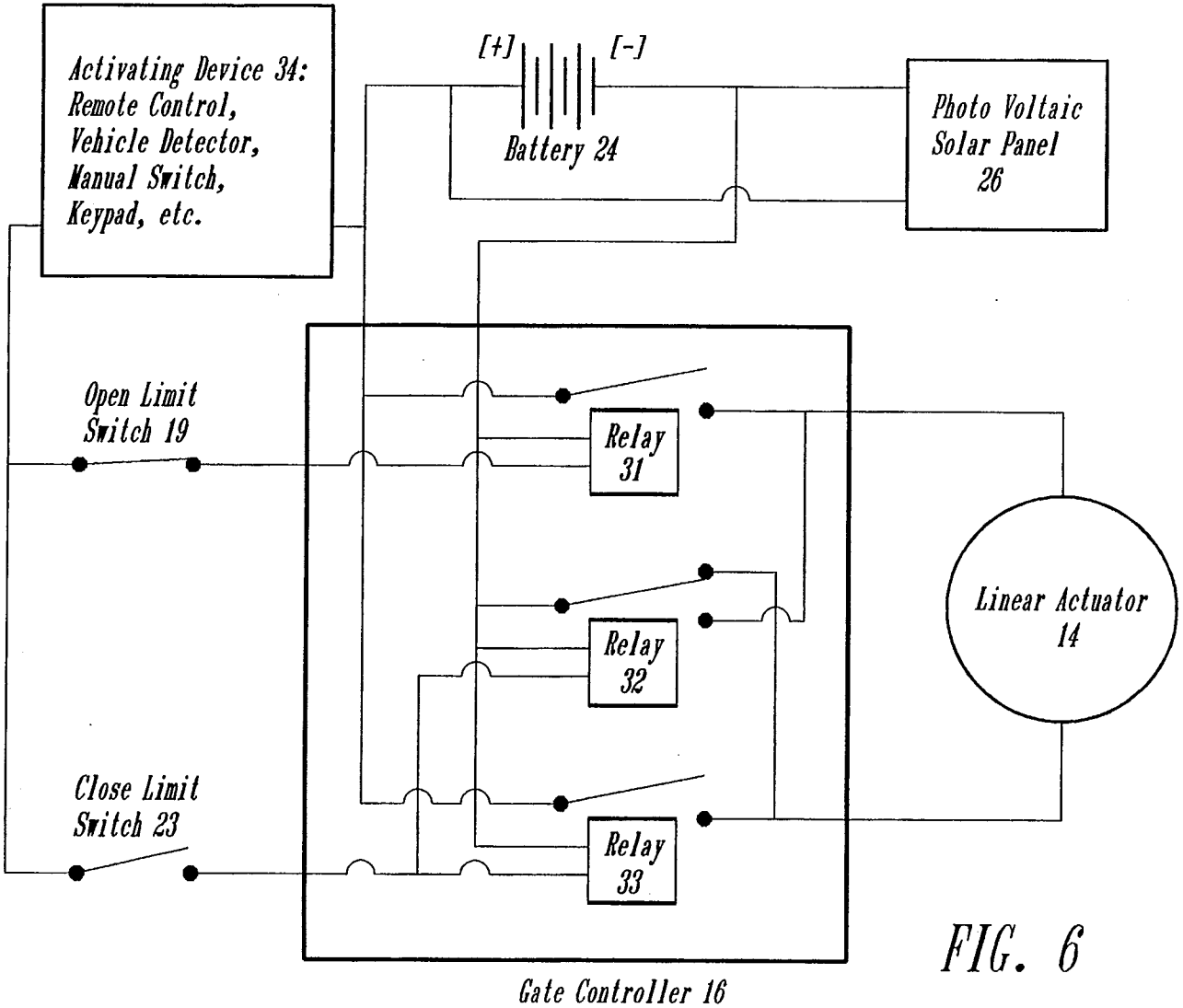
FIG. 6 is a schematic of the gate control electrical circuit.

Referring to FIG. 6 the gate control electrical circuit is displayed schematically. For simplicity, only the basic logic of the gate controller is illustrated. The actual gate controller comprises a printed circuit board and several relays. The electrical power source for the gate may be of any type and voltage and is not limited to the form illustrated herein. The gate controller 16 uses relays 31, 32, and 33 to control the linear actuator 14. When the gate is in a closed position, close limit switch 23 is open and the open limit switch 19 is closed. The gate is activated by one of the activating devices 34 and the signal travels through the open limit switch 19 to relay 31 which closes, supplying power from the battery 24 to the linear actuator 14 which opens the gate. When the gate reaches the open position, the open limit switch 19 opens shutting off the power to the linear actuator 14 which stops the gate. With the gate In the open position, the close limit switch 23 is closed and the open limit switch 19 is open. The gate is again activated by an activating device 34 and the signal travels through the close limit switch 23 to relay 32 which reverses position and relay 33 which closes, supplying power of a reversed polarity to the linear actuator 14 which closes the gate. When the gate reaches the closed position, the close limit switch 23 opens shutting off the power to the linear actuator 14 which stops the gate. The photovoltaic solar panel 26 charges the battery 24.

Figure 7:
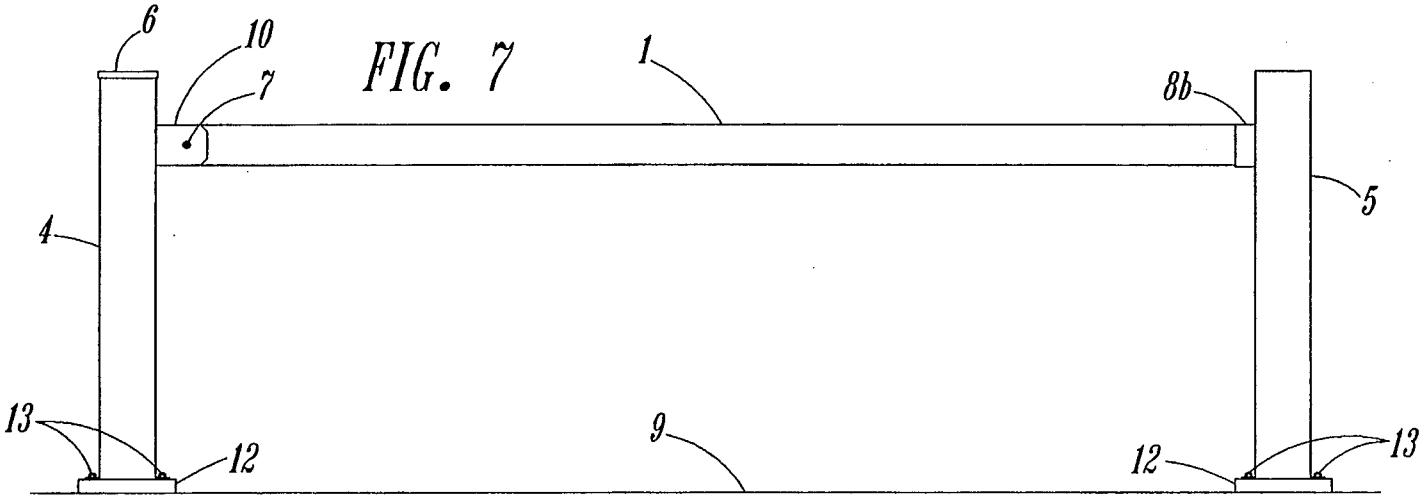
FIG. 7 is a view of the gate with a single horizontal rail.

FIG. 7 illustrates another embodiment of the gate with a single horizontal rail as opposed to a plurality of horizontal rails.

FIG. 8 illustrates another embodiment of the gate operating system where the linear actuator 14 is mounted above the offset pivot arm 20. In this embodiment the linear actuator 14 is powered pneumatically or hydraulically through line 36 by compressor 35.

Figure 9:
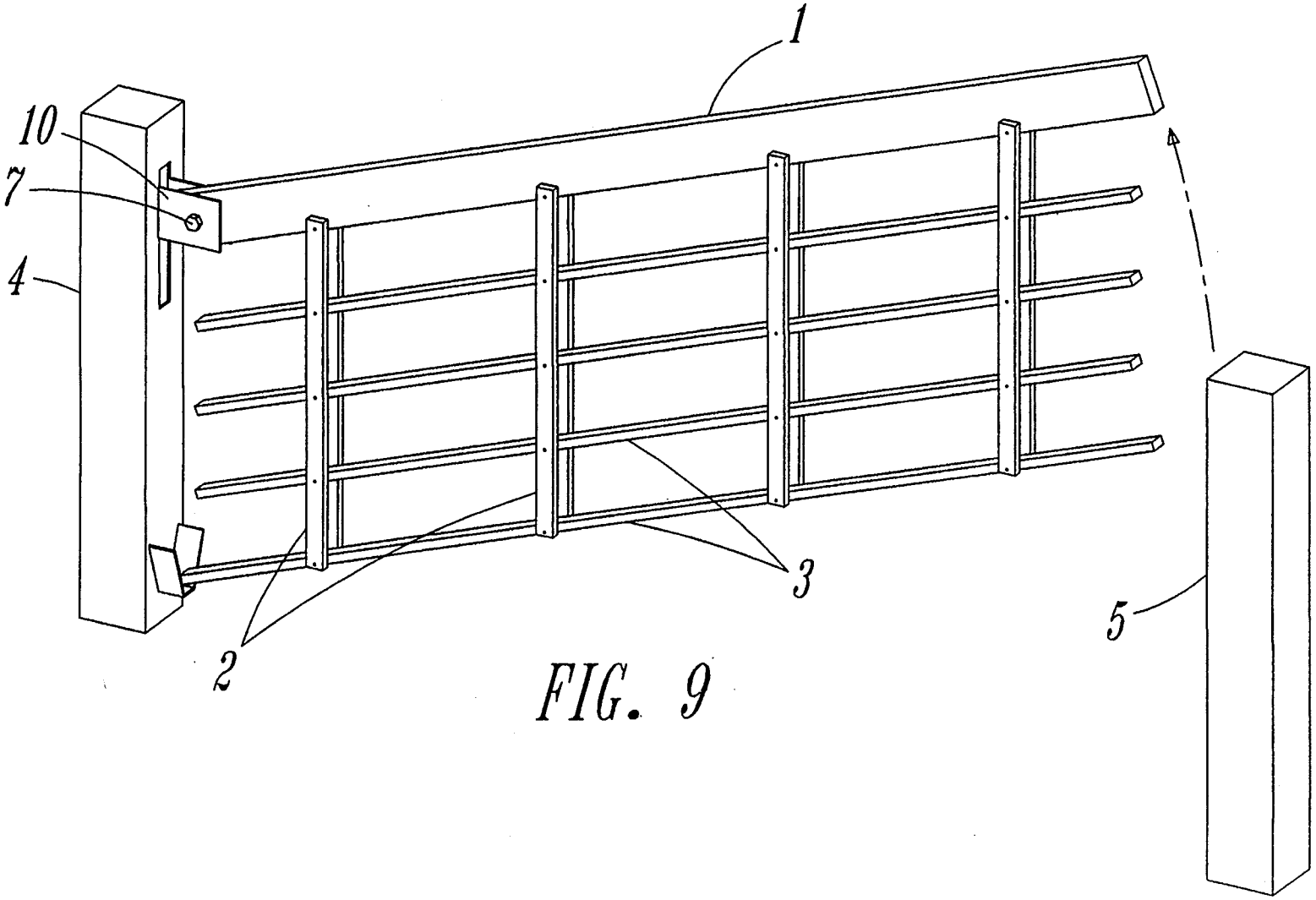
FIG. 9 is a perspective view of the gate as it is opening.

FIG. 9 is a perspective view of the gate as it is opening. The large rail 1, the vertical members 2, and the smaller rails 3 are pivoting vertically about the pivot bolt 7.

The foregoing describes a vertical lift gate which opens to a true vertical position. The gate operating mechanism is protected from the weather inside the gate post making the gate particularly well suited to climates where rain and snow are present. The gate operating system is more simple and requires less maintenance than prior designs. The gate operating mechanism is very compact and enclosed in a hollow gate post of conventional size and appearance. The compact size of the operating mechanism and the capability to open to a true vertical position make this gate more suitable for use as a replacement to existing conventional swing gates where space is limited and the pathway cannot be widened. The present gate also maintains the appearance of the conventional gate it is replacing.

While the present invention is described in only a few preferred embodiments, it will occur to those skilled in the art that many changes may be made without departing from the true spirit and scope of the invention. One of these changes might be to move the limit switches from the offset pivot arm and mount them inside the linear actuator. Another change would be to alter the shape of the offset pivot arm while maintaining the mounting positions for the pivot bolt, the counterbalance springs, and the linear actuator. All such variations, are intended to be included within the scope of the present invention as limited only by the following claims.

I claim:

1. A vertical lift gate, the improvement being:

a fixed hollow gate post means;

a pivot support means being attached externally and proximate to an upper end of said fixed hollow gate post means;

an offset pivot arm having an interior and exterior end and being pivotally attached to said pivot support means with the pivotal attachment being external to said fixed hollow gate post means;

a gate means being attached to the exterior end of the offset pivot arm;

a counterbalance spring means with one end being attached to the interior end of the offset pivot arm and the opposite end being attached to a lower inside end of the fixed hollow gate post means;

a linear actuator means with one end being attached to the interior end of the offset pivot arm and the opposite end being attached to the lower inside end of the fixed hollow gate post means.

2. The vertical rift gate of claim 1 wherein the gate means when closed comprises a plurality of horizontal parallel mils connected by vertical members and when open is folded tightly together at a true vertical position.

3. The vertical lift gate of claim 1 wherein the hollow gate post means contains the counterbalance spring means and the finer actuator means and comprises a removable lid means at its upper end, end a small opening on one side proximate to its upper end through which passes the offset pivot arm.

* * * * *

UNITED STATES PATENT AND TRADEMARK OFFICE

CERTIFICATE OF CORRECTION

PATENT NO. : 5,440,838

DATED : August 15, 1995

INVENTOR(S) : Christopher M. Lesser

It is certified that error appears in the above-indentified patent and that said Letters Patent is hereby corrected as shown below:

In column 2, line 49, the word "tight", should be --tightly--, and the word "end", should be --and--.

In column 6, line 19, the word "rift", should be --lift--.

In column 6, line 21, the word "mils", should be --rails--.

In column 6, lines 19 - 23, Claim 2 is incorrectly formatted and is not intended to be separated or broken into indented format. The claim should be formatted as follows:

2. The vertical lift gate of claim 1 wherein the gate means when closed comprises a plurality of horizontal parallel rails connected by vertical members and when open is folded tightly together at a true vertical position.

In column 6, line 27, the word "finer", should be --linear--.

In column 6, line 28, the second occurrence of the word "end", should be --and--.

UNITED STATES PATENT AND TRADEMARK OFFICE

CERTIFICATE OF CORRECTION

PATENT NO. : 5,440,838

DATED : August 15, 1995

INVENTOR(S) : Christopher M. Lesser

It is certified that error appears in the above-indentified patent and that said Letters Patent is hereby corrected as shown below:

In column 6, lines 24 - 30, Claim 3 is incorrectly formatted and is not intended to be separated or broken into indented format. The claim should be formatted as follows:

3. The vertical lift gate of claim 1 wherein the hollow gate post means contains the counterbalance spring means and the linear actuator means and comprises a removable lid means at its upper end, and a small opening on one side proximate to its upper end through which passes the offset pivot arm.

Signed and Sealed this

Thirty-first Day of October 1995

*Attest:*

*Attesting Officer*

Bruce Lehman

BRUCE LEHMAN

*Commissioner of Patents and Trademarks*